United States Patent [19]

Pong

[11] Patent Number: 5,027,632

[45] Date of Patent: Jul. 2, 1991

[54] NO-TWIST SLIT-ROLLING APPROACH ("NTA") APPARATUS AND METHOD FOR MANUFACTURING STEEL REINFORCING ROD

[76] Inventor: David T. Pong, Shiu Wing Steel Limited, 1209 Jardine House, Hong Kong, Hong Kong

[21] Appl. No.: 549,351

[22] Filed: Jul. 6, 1990

Related U.S. Application Data

[63] Continuation-in-part of Ser. No. 474,285, Feb. 2, 1990.

[30] Foreign Application Priority Data

May 3, 1990 [EP] European Pat. Off. ..... 90108378.2

[51] Int. Cl.[5] ..... B21B 1/18

[52] U.S. Cl. ..... 72/204; 72/235

[58] Field of Search ..... 72/203, 204, 235, 228

[56] References Cited

U.S. PATENT DOCUMENTS

| | | | |
|---|---|---|---|
| 1,935,048 | 11/1933 | Gassen | 72/228 |
| 3,122,949 | 3/1964 | Brandenburg et al. | 72/235 |
| 3,486,359 | 12/1969 | Hein | 72/250 |
| 3,625,043 | 12/1971 | Neumann et al. | 72/365.2 |
| 3,930,395 | 1/1976 | Bretschneider et al. | 72/251 |
| 3,945,234 | 3/1976 | Steinbock | 72/235 |
| 4,193,283 | 3/1980 | Bowman et al. | 72/204 |
| 4,357,819 | 11/1982 | Elley | 72/204 |
| 4,457,154 | 7/1984 | Ohba | 72/240 |
| 4,537,055 | 8/1985 | Woodrow et al. | 72/235 |

FOREIGN PATENT DOCUMENTS

| | | | |
|---|---|---|---|
| 2755927 | 6/1979 | Fed. Rep. of Germany | 72/235 |
| 3602522 | 7/1987 | Fed. Rep. of Germany | 72/204 |
| 0043979 | 12/1971 | Japan | 72/234 |
| 0498977 | 1/1976 | U.S.S.R. | 72/235 |

OTHER PUBLICATIONS

Morgan Worcester Brochure for Vee Mill (A No-Twist Rod Finishing Mill), 4 pages, Feb. 1990.

*Primary Examiner*—Lowell A. Larson
*Assistant Examiner*—Thomas C. Schoeffler
*Attorney, Agent, or Firm*—Ladas & Parry

[57] ABSTRACT

A no-twist ("NTA") apparatus and method for manufacturing steel reinforcing bar which allows steel reinforcing bar to be manufactured with greater speed and precision than by conventional methods. The NTA method employs numerous stands, with the shafts of the rolls of the first two stands offset 45° from a predetermined plane and 90° from each other. The third and fourth stands comprise rolling and splitting stands and are the shafts of their rollers are perpendicular or parallel to the predetermined plane and form equal angles with the shafts of the first two stands so that the bar can be fed to the rolling and splitting stands without intermediate twisting and the single bar can be split into a plurality of bar segments. The remaining stands are arranged into at least two lines of stands, in each of which the sides of the rolls of the first stand are offset 45° in a first direction from the predetermined plane and the sides of the rolls of the second stand are offset 45° in a second direction opposite to said first direction relative to the predetermined plane. Alternatively, the sides of the rolls of the first and second stands in the two lines are respectively offset either by 90° and 0° or 0° and 90°.

15 Claims, 7 Drawing Sheets

NO-TWIST SLIT-ROLLING APPROACH ("NTA") APPARATUS AND METHOD FOR MANUFACTURING STEEL REINFORCING ROD

CROSS-REFERENCE TO RELATED APPLICATION

This application is a continuation-in-part to U.S. patent application Ser. No. 07/474,285, filed Feb. 2, 1990.

FIELD OF THE INVENTION

This invention pertains to the field of manufacturing steel reinforcing bar.

BACKGROUND OF THE INVENTION

Various methods of manufacturing steel reinforcing bar have been well-known in the art for many years. Reinforcing bar is vital to the construction of roads, bridges, and the other concrete structures. In the manufacture of reinforcing rod, hot steel stock or rod is typically passed between several pairs of rollers, termed "rolls," driven in opposite directions, which is termed "rolling." Repeated rolling is necessary to give the finished steel reinforcing rod sufficient tensile strength and rolling also aids in descaling, or the removal of surface imperfections on the steel rod. The pair of rolls are usually mounted inside a housing on shafts, and the complete unit is commonly known as "a stand." The steel rod assumes the shape of the roll profile as it passes through the stand. In the case of round steel reinforcing bars, the steel rod must be rolled by alternate stands on opposite sides so that the resulting product is symmetrical.

In a conventional rolling mill layout, all of the stands are arranged on the same axis, and the steel rod are twisted approximately 90° by either twist guides or twist rollers as they enter the next stand. This is termed the twist-method. Use of this method for production of steel rod has often been troublesome, because an incorrect setting of the twist angle, or wear in the twist rollers can prevent the steel rod from entering the next stand in a proper alignment, or at all. Despite attempts to overcome these problems, they remain a major source of downtime. Use of the twist-method to produce steel rod is also problematic in that there is a greater possibility of surface defects resulting from contacts of the steel bar with the twist guides or twist rollers.

The development of the arrangement of stands in alternate horizontal and vertical axes has eliminated many of the inherent shortcomings of the twist-method, especially in the rolling of round products. This arrangement has been commonly adopted by modern-day rolling mills, especially in the production of alloy steel products, where the surface finish of the final product is very critical.

In the production of small diameter round steel reinforcing bar, because of its small cross section and hence light mass per length, very high rolling speeds must be maintained in order to achieve high productivity. However, with higher rolling speeds, the problems associated with twisting of the bar between the stands are amplified. Further problems arise with the collection of the finished steel reinforcing bars after the rolling process at such high speeds, and the collection is usually done by coiling the bars as they leave the rolling process, and thereafter, the steel rod must be straightened by a separate process. At lower speeds, the finished straight rod can be deposited directly onto cooling beds.

Recently, a new method for producing steel reinforcing bar has been developed which involves rolling the steel stock into a profile which is later slit and is further rolled into the required shape and sizes. This is termed the "slit-rolling" method The advantage of this system is that the same productivity can be maintained at half the rolling speeds and hence the finished bars can be delivered straight onto conventional cooling beds. However, the adoption of the slit-rolling method using either the conventional horizontal stand arrangement or the horizontal and vertical stand arrangement still has inherent shortcomings as described below.

FIG. 1 illustrates the typical horizontal stand slit-rolling mill, without showing rod twisting guides or twisting rollers, the base, or the turning means for the rollers. Twisting of the steel rod remains necessary between all stands including between the final two stands 17 and 18. The twisting of each rod emerging from stand 17 is critical because if problems occur on one of the stands, the production on the other stand is interrupted as well, thereby causing a bottleneck in production.

A typical horizontal and vertical slit-rolling mill, without showing rod twisting guides or twisting rolls, or the base, or the turning means for the rolls, is illustrated in FIG. 2. Although the majority of the twisting is eliminated, twisting of the steel rod remains necessary between stands 14 and 15 and from stand 15 to 16. Furthermore, the overlapping of the slitted oval section from stand 17 to 18 involves bending the steel rod at its longer axis on its cross section, which results in the full advantage of the horizontal and vertical arrangement not being realized.

SUMMARY OF THE INVENTION

The present invention provides an improved apparatus and method for producing steel reinforcing bar which eliminates the shortcomings found in the prior art methods of producing steel reinforcing bar, and the method is called "the NTA method," ("NTA" stands for no-twist approach). FIGS. 3 and 4 illustrate two embodiments of the apparatus employing the NTA method without showing the base, the housings for the stands or the means to turn the rolls comprising the stands, which are standard design, and which are deleted for clarity of presentation.

A first feature of both embodiments of the apparatus is the arrangement of the sides of the rolls of stands 13 and 14 at 45° to a vertical plane through A—A and at approximately 90° to each other, resulting in the steel stock being presented at stand 15 without twisting being required.

A second feature of the first embodiment of the apparatus is its arrangement of the sides of the rolls of stand 17 being vertical and the stand 18 being horizontal to the vertical plane through A—A and at approximately 90° to each other, which accomplishes the goal of rolling the steel rod without the need for twisting.

A second feature of the second embodiment of the apparatus is its arrangement of the sides of the rolls of stands 17' and 18' at approximately 45° in opposite directions to the vertical plane through A—A and at approximately 90° to each other, which accomplishes the goal of rolling the steel without the need for twisting.

BRIEF DESCRIPTION OF THE DRAWINGS

In describing both embodiments of the apparatus, reference will be made to the accompanying drawings wherein:

FIG. 5 is a cross sectional view of the steel rod prior to entering stand 13 viewed through plane A—A.

FIG. 6 is a view of stand 13, viewed through plane A—A.

FIG. 7 is a cross-sectional view of the steel rod after rolling by stand 13 and aligned to enter stand 14, viewed through plane A—A.

FIG. 8 is a perspective drawing of stand 14, viewed through plane A—A.

FIG. 9 is a cross section of stock after being rolled by stand 14, viewed through plane A—A.

FIG. 10 is a diagram of stand 15, viewed through plane A—A.

FIG. 11 is a cross sectional view of the steel stock after being rolled by stand 15 and aligned to enter stand 16, viewed through A—A.

FIG. 12 is a drawing of stand 16, viewed through plane A—A.

FIG. 13 is a cross-sectional view of one of the steel rods after being rolled and slit by stand 16 and before entering stands 17, viewed through plane A—A.

FIG. 14 is a drawing of stands 17, viewed through plane A—A.

FIG. 15 is a cross-sectional view of the steel rods after being rolled by stand 17 and aligned to enter stand 18, viewed through plane A—A.

FIG. 16 is a drawing of stand 18, viewed through plane A—A.

FIG. 17 is a cross-sectional view of the finished steel reinforcing bar, viewed through plane A—A.

FIG. 18 is a drawing of stands 17', viewed through plane A—A.

FIG. 19 is a cross-sectional view of the steel rods after being rolled by stand 17' and aligned to enter stand 18', viewed through plane A—A.

FIG. 20 is a drawing of stand 18', viewed through plane A—A.

FIG. 21 is a cross-sectional view of the finished steel reinforcing bar, viewed through plane A—A.

DETAILED DESCRIPTION

Figure 1:
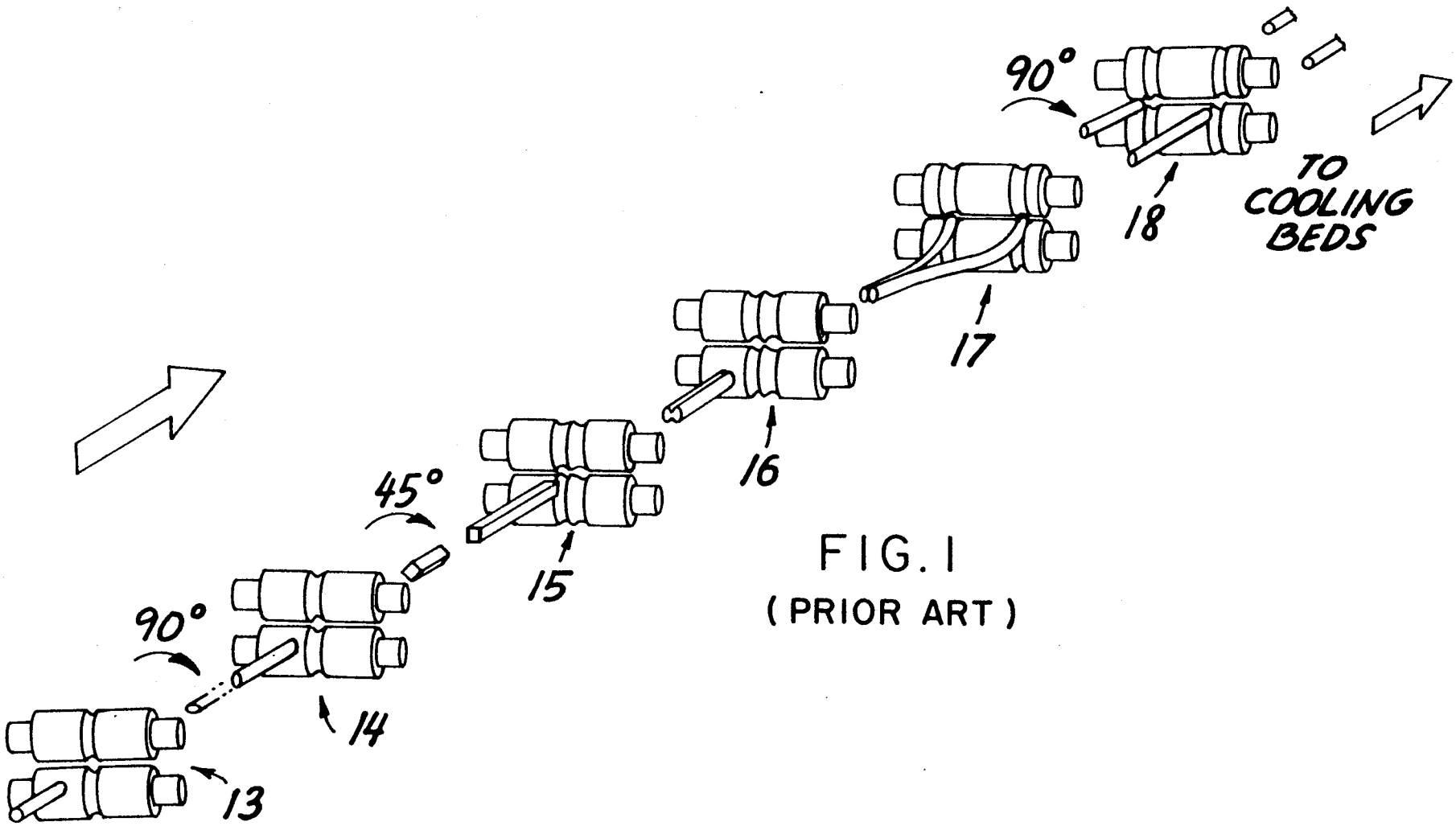
FIG. 1 (PRIOR ART)
FIG. 1 is a diagram of a conventional slit-rolling mill incorporating horizontal stands.
Figure 2:
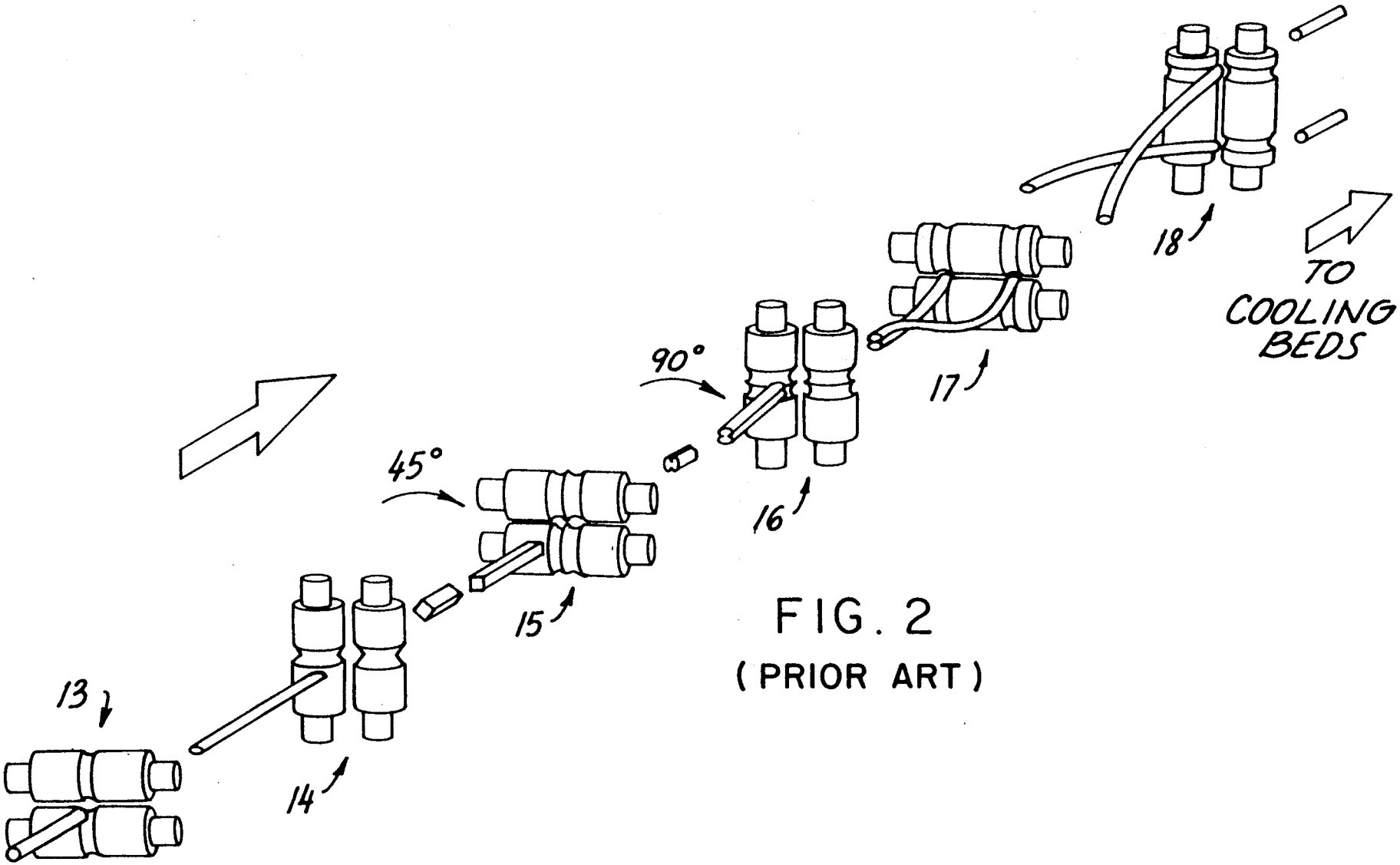
FIG. 2 (PRIOR ART)
FIG. 2 is a diagram of a conventional slit-rolling mill incorporating vertical and horizontal stands.
Figure 3:
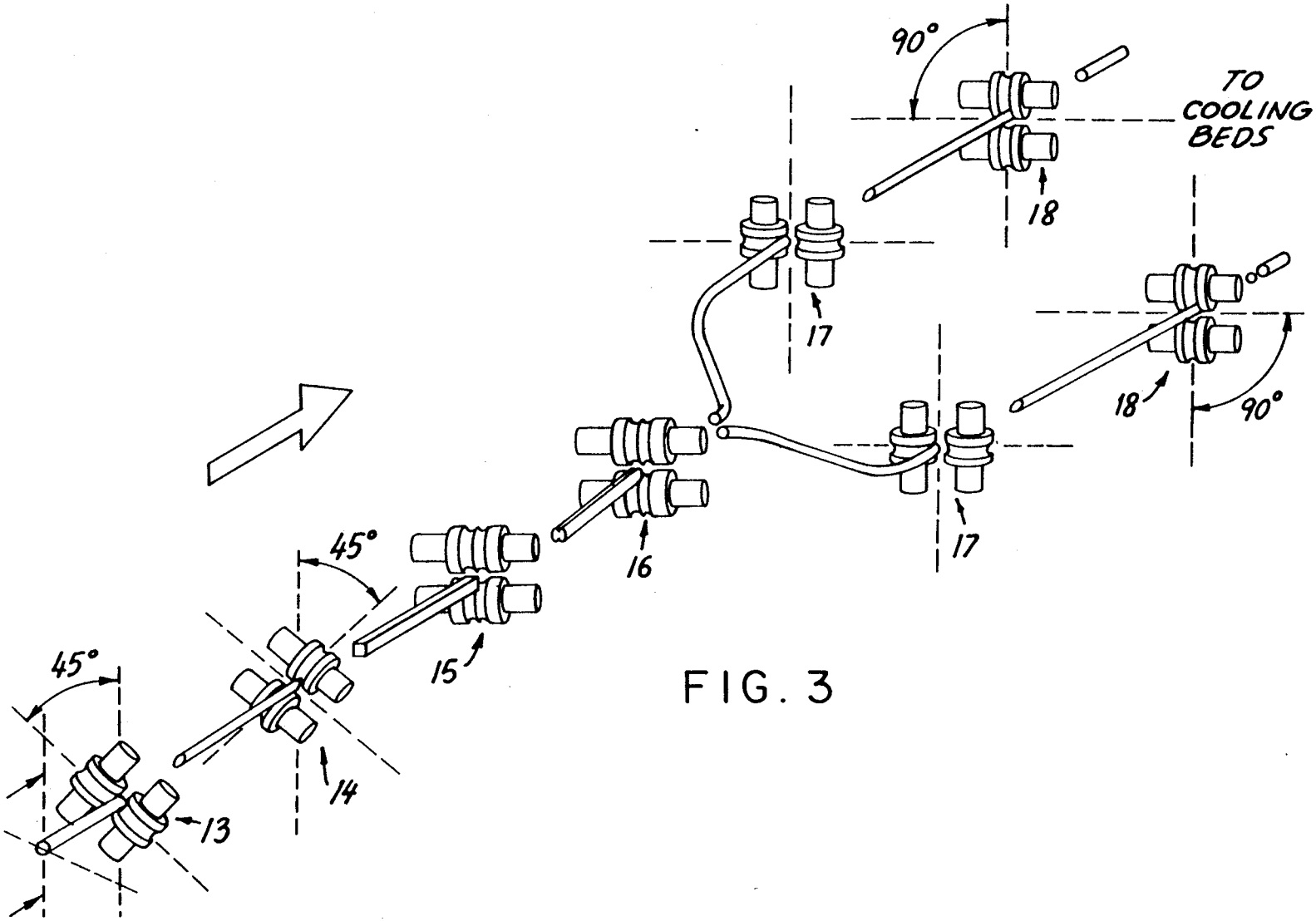
FIGS. 3 and 4 are schematic side views of the two embodiments of the apparatus without showing the base, the housing for the stands, or the means to rotate the roll comprising the stands, with the deleted components being of standard design. The two embodiments are similar except for the orientations of stands 17 and 17' and 18 and 18'.
Figure 4:
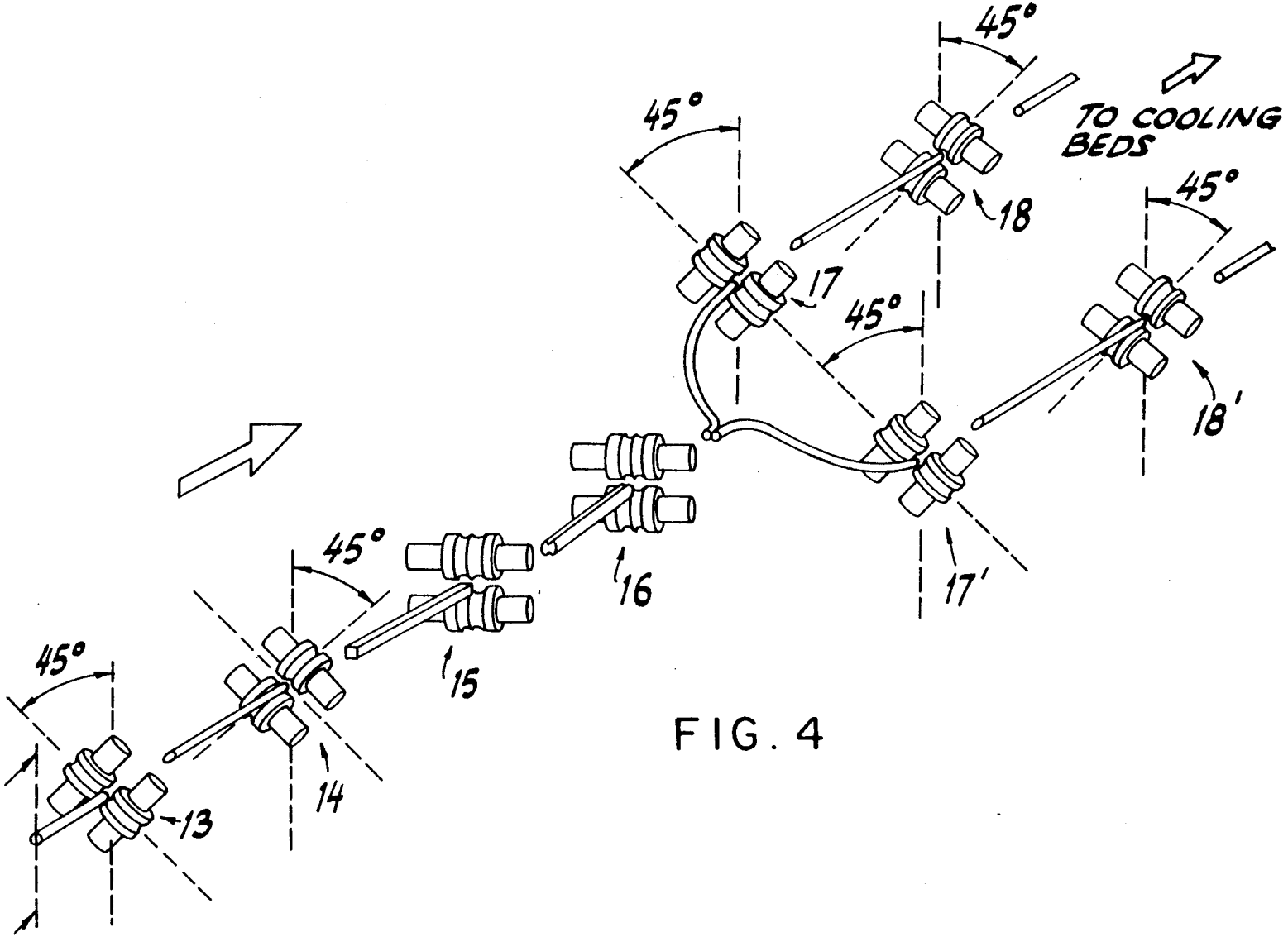

Referring now to the drawings, there are illustrated in FIGS. 3 and 4, perspective schematic views of the first and second embodiments of the apparatus embodying the present invention. For the sake of clarity, the base of the apparatus, the housing for the stands, and the driving means for turning the rolls comprising the stands are not shown. The apparatus allows the steel rod to be rolled and shaped without requiring the steel rod to be twisted. As can be seen from FIGS. 3 and 4, the stands are arranged with their sides in various orientations to the vertical plane through A—A.

Figure 5:
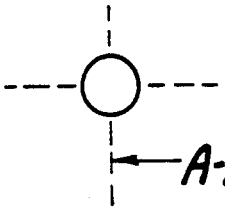
FIGS. 5–13 illustrate the stand and steel rod at various stages of rolling common to both embodiments shown in FIGS. 3 and 4.

The first embodiment of the invention, shown in FIG. 3, allows steel reinforcing rod to be manufactured as follows: The starting steel stock, shown in FIG. 5, is rolled by a first stand 13, with rolling surfaces 231 defining an oval, which is oriented with the sides 233 of the rolls 23 offset approximately 45° in one direction from the vertical plane A—A. First stand 13 is shown in greater detail by FIG. 6. The resulting rod, which has an oval shaped cross-section, illustrated in FIG. 7, is next rolled by a second stand 14, shown in greater detail in FIG. 8, which stand has rolling surfaces 241 defining a square and which is oriented with the sides 243 of the rolls 24 offset approximately 45° in a second direction from the vertical plane A—A. The oval shaped steel rod does not require twisting to enter the second stand 14 as the longer dimension of its oval cross-section as rolled is already oriented diagonally with the square rolling surfaces of the second stand 14.

Figure 9:
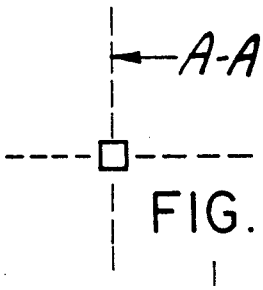
Figure 13:
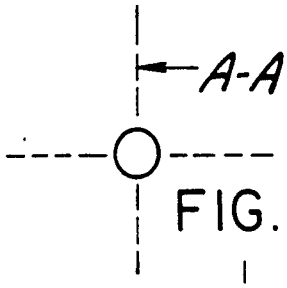
Figure 10:
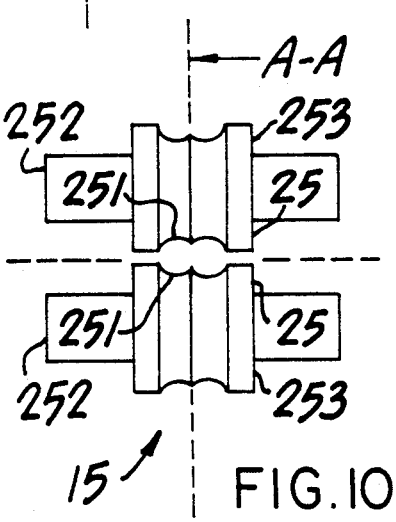

The resulting steel rod, having a generally square cross-section, illustrated in FIG. 9, is next rolled by stand 15, having rolling surfaces 251 defining two slightly overlapping circles, which is oriented with the sides 253 of its rolls 25 offset approximately 0° from the vertical plane A—A, as can be best seen in FIG. 10. The steel rod which emerges from stand 15 has a cross-section of two slightly overlapping circles, depicted in FIG. 11. Following this, the steel rod is rolled by a stand 16 having the same spatial orientation as the preceding stand, but with a rolling surface 261 defining two abutting circles, as is best shown in FIG. 12. The rolling by stand 16 splits the rod into two generally circular rods, one of which is shown in FIG. 13.

Figure 14:
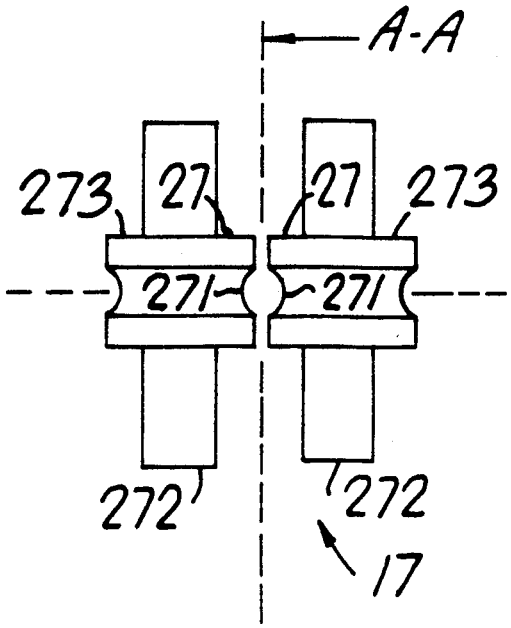
Figure 17:
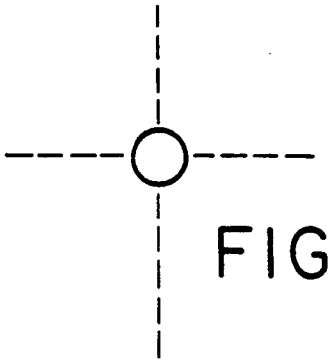

The two rods are next presented to be rolled one each by two separate lines of stands 17–18, with the first stand 17 in each line of stands being aligned with the sides 273 of its rolls 27 offset approximately 90° from the vertical plane A—A, and with rolling surfaces 271 generally defining a circle, as shown in FIG. 14. The steel rods resulting from rolling by stands 17 have a generally circular cross-section, shown in FIG. 15. Next, the two steel rods are rolled one each by stands 18 defining a generally circular rolling surface 281 and aligned with the sides 283 of their rolls 28 offset approximately 0° from a vertical plane, as can be seen in FIG. 16. The offsetting of the orientations of the two stands allow the steel rods to be rolled uniformly on all sides without twisting of the steel rod being required. The final product is two steel rods with circular cross-sections, one of which is shown in FIG. 17.

The second embodiment, shown in FIG. 4, is similar to the first embodiment, except for the orientation of the stands in the lateral lines of stands located at the end of the apparatus where the rolling of the steel rod is finished. The description of the first stages, recited above with reference to FIGS. 3–13 remains the same.

Figure 19:
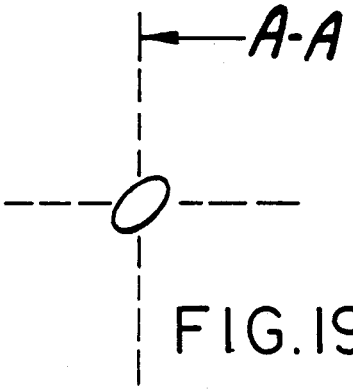
FIGS. 18–21 illustrate the additional stands and cross-section of steel rods at various stages of rolling unique to the second embodiment as shown in FIG. 4.
Figure 18:
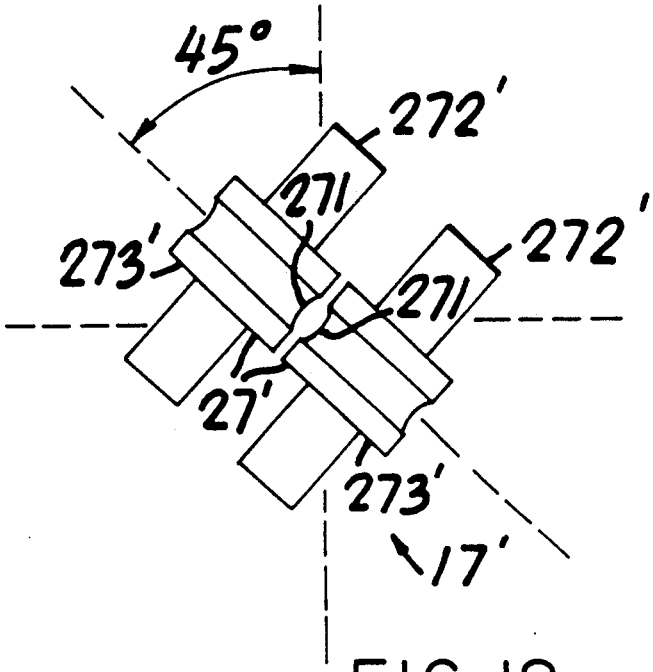
Figure 21:
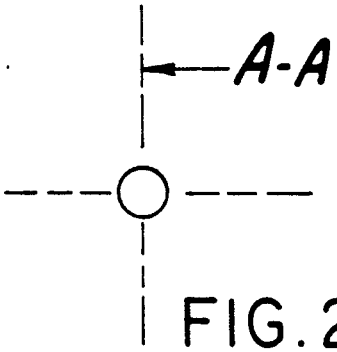

In the second embodiment, the two rods are rolled after stand 16 by two separate lines of stands with the first stand 17' in each line of stands being aligned with the sides 273' of their rolls 27' offset approximately 45° in one direction from the vertical plane A—A, and with the rolling surfaces 271' defining an oval, best shown in FIG. 18. The steel rods resulting from rolling by stands 17' have an oval cross-section, as shown in FIG. 19. Next, the steel rods are rolled by stands 18' having a circular cross-section and aligned with the sides 283' of their rolls 28' offset approximately 45° in a second direction, opposite the first direction, from the vertical plane A—A. The offsetting of the two stands by 45° from the vertical plane and at 90° to each other allows the steel rods to be rolled uniformly on all sides without twisting being necessary. The final product is two steel rods with circular cross-sections, one of which is shown in FIG. 21.

Turning now to the detailed description of the two embodiments, the stand and rolling product are as follows:

FIGS. 5 through 13 are common to both embodiments of the apparatus, and are views through plane A—A, showing the orientation of the stands and the cross-sections of the steel rod after being rolled by each stand.

FIG. 5 is a cross-sectional diagram of the steel stock prior to being rolled by stand 13.

Figure 6:
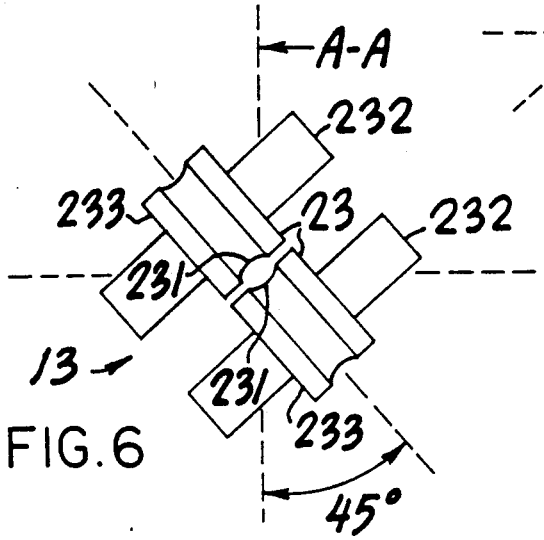
Figure 7:
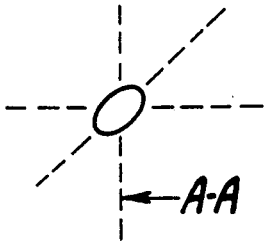

FIG. 6 provides a detailed view of stand 13, without showing its housing, viewed through plane A—A. Stand 13 comprises two adjacent rolls 23 with concave semi-oval shaped rolling profile, each roller turning in opposite directions along their parallel shafts 232, and with the sides of the rolls 233 offset approximately 45° in one direction from the plane through A—A.

FIG. 7 is a cross-sectional view of the oval shaped steel rod after rolling in stand 13 with its longer dimension offset at approximately 45° from the plane through A—A.

Figure 8:
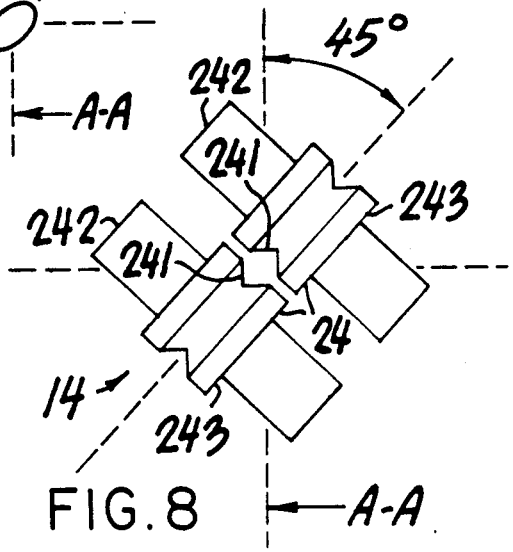

FIG. 8 illustrates stand 14, without showing its housing, viewed through plane A—A. Stand 14 comprises two adjacent rolls 24 with triangular shaped roll profiles, each roller turning in opposite directions along their parallel shafts 242 and with the sides of the rolls 243 offset approximately 45° in an opposite direction from the plane through A—A as the rolls in stand 13. The sides of the roll 23 and 24 comprising stands 13 and 14 are thus offset approximately 90° from each other.

FIG. 9 is a diagram of the square steel rod after being rolled by stand 14, viewed through A—A.

FIG. 10 is a view of stand 15, without showing its housing viewed through A—A. Stand 15 comprises two adjacent rolls 25 with roll profiles 251 in the shape of two slightly overlapping semi-circles, each roll turning in opposite directions along their parallel shafts 252, with the sides of the roll 253 parallel to the plane through A—A.

Figure 11:
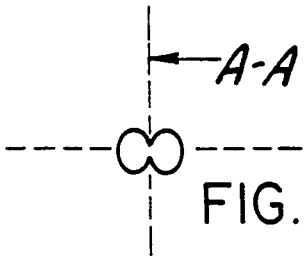
Figure 12:
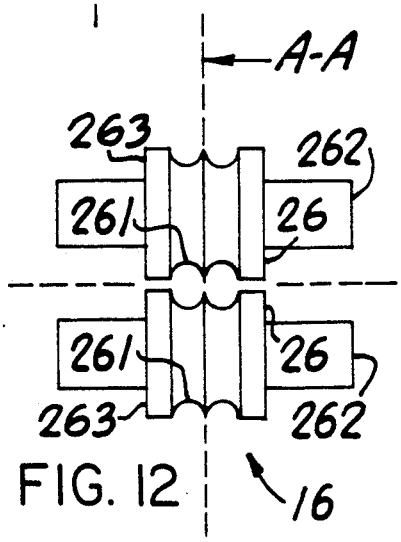

FIG. 11 is a cross-sectional view of the steel rod as it emerges from stand 15, viewed through plane A—A.

FIG. 12 is a view of stand 16, without showing its housing, viewed along plane A—A. Stand 16 comprises two adjacent rolls 26, with roll profiles 261 in the shape of two adjacent semi-circles, each roller turning in opposite directions along their parallel shafts, 262, with their sides 263 parallel to the plane through A—A. Stand 16 slits the entering steel rod shown in FIG. 11 into two steel rods.

FIG. 13 is a cross-sectional view of the steel rod as it emerges from stand 16, viewed through plane A—A.

FIGS. 14–17 are unique to the first embodiment.

FIG. 14 is a view of stands 17, without showing their housing, viewed through plane A—A. Stands 17 comprise two adjacent rolls 27, with roll profiles 271 in the shape of a concave semi-circle, each roll turning in opposite direction along their parallel shafts 272, with the sides of the rolls 273 offset approximately 0° from the plane through A—A.

Figure 15:
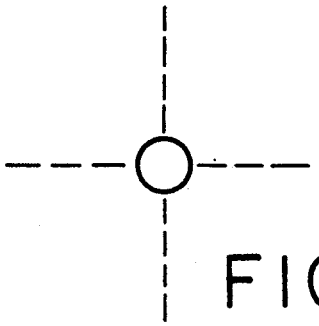
FIGS. 14–17 illustrate the additional stands and cross-section of steel rods at various stages of rolling unique to the first embodiment as shown in FIG. 3.
Figure 16:
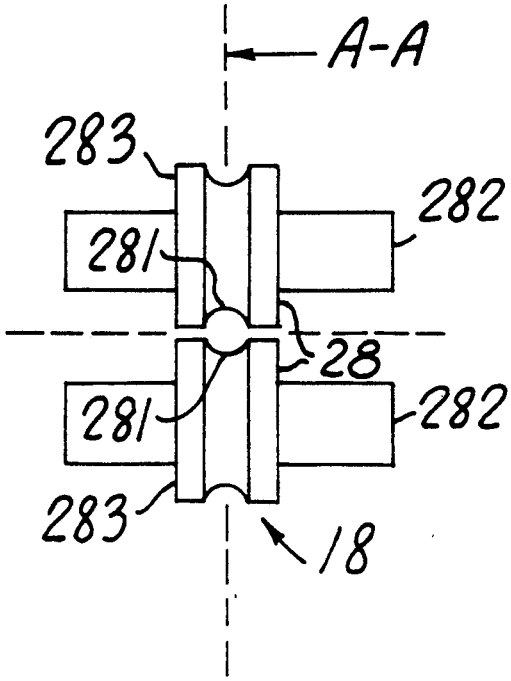

FIG. 15 is a cross-sectional view of the steel rods as they emerge from stands 17.

FIG. 16 is a view of stands 18 without showing their housings, viewed through plane A—A. Stands 18 comprise two adjacent rolls 28, containing roll profiles 281 in the shape of a concave semi-circle, each roll turning in opposite direction along their parallel shafts 282, with the sides of the rolls 283 offset approximately 90° from the plane through A—A as the rolls in stands 17.

FIG. 17 is a cross-sectional view of finished reinforcing rod as they emerge from stands 18.

The second embodiment of apparatus is substantially similar to the first embodiment, except with respect to the orientation of its stands 17' and 18', and these features are illustrated in FIGS. 18–21.

FIG. 18 is a view of stands 17', without showing their housing, viewed through plane A—A. Stands 17' comprise two adjacent rolls 27', with roll profiles 271' in the shape of a concave semi-oval, each roll turning in opposite direction along their parallel shafts 272', with the sides of the rolls 273' offset in one direction by approximately 45° from the plane through A—A.

FIG. 19 is a cross-sectional view of the steel rods as they emerge from stands 17'.

Figure 20:
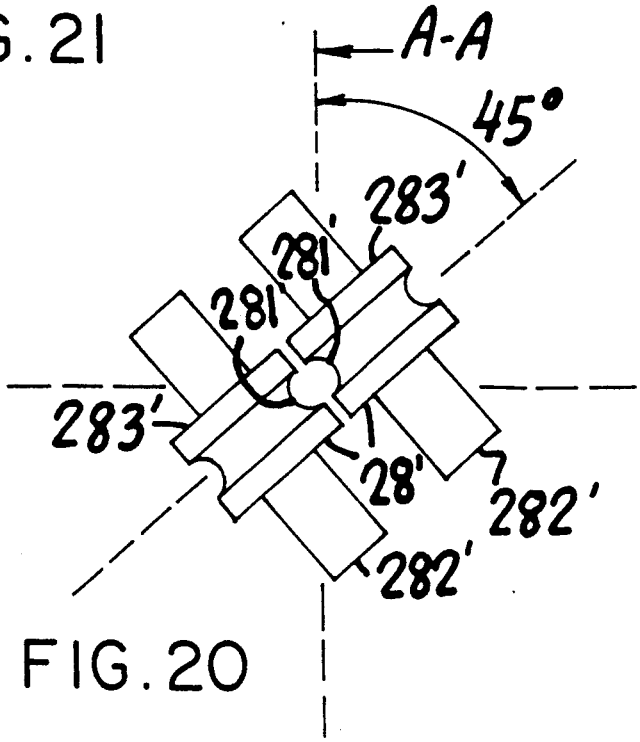

FIG. 20 is a view of stands 18' without showing their housings, viewed through plane A—A. Stands 18' comprise two adjacent rolls 28, containing roll profiles 281 in the shape of a concave semi-oval, each roll turning in opposite direction along their parallel shafts 282', with the sides of the rolls 283' offset approximately 45° in an opposite direction from the plane through A—A as the rolls in stands 17'.

FIG. 21 is a cross-sectional view of the finished reinforcing rod as they emerge from stands 18'.

It should be borne in mind that the drawings are not rendered in actual scale so that certain features of the invention can be brought out and depicted.

The drawings and the foregoing description are not intended to represent the only form of the invention in regard to the details of its construction and manner of operation. In fact, it will be evident to one skilled in the art that modifications and variations may be made without departing from the spirit and scope of the invention. Changes in form and in the proportion of parts, as well as the substitution of equivalents, are contemplated as circumstances may suggest or rendered expedient; and although specific terms have not been employed they are intended in a generic and descriptive sense only and not for purposes of limitation. The scope of the invention being delineated in the following claims.

I claim:

1. A no-twist slit-rolling apparatus for the production of steel reinforcing bar from steel rod having stands through which the steel rods being rolled pas, each stand having rolls with adjacent roll profiles and mounted on shafts on the sides of the rolls, said apparatus comprising:

a first stand which is aligned with the sides of its rolls offset approximately 45° in a first direction from a reference plane, and a second stand, disposed at a distance from the first stand, aligned with the sides of its rolls offset approximately 45° in a second direction, opposite to said first direction, from said reference plane, with the sides of the rolls in the two stands thus offset from each other approximately 90°, both stands being disposed at on end of the apparatus, where the rolling of the steel rod begins; slitter means including opposite rolls having sides disposed approximately at an angle of 45° with respect to the side's of the rolls in said first and second stands, said slitter means being located downstream of the second stand for receiving the steel rod from said second stand, without intermediate twisting, for slitting the rod into divided rod segments; a plurality of further stands, disposed in lateral offset lines downstream of the slitter means at the opposite end of the apparatus for receiving respective divided rod segments and completing the rolling thereof; and means for conveying the rod segments from the slitter means to said stands disposed downstream therefore without twisting of said rod segments.

2. A no-twist slit-rolling apparatus as claimed in claim 1, wherein one of the further stands in each of the lines of laterally offset stands is aligned with the sides of its rolls offset approximately 45° in a first direction to said reference plane, and wherein another stand in each of the lines of laterally disposed stands is disposed at a distance from said one stand, and aligned with the sides of its rolls offset approximately 45° in a second direction, opposite to said first direction, relative to said reference plane, such that the sides of the rolls are offset by approximately 90°.

3. A no-twist slit-rolling apparatus as claimed in claim 1 wherein one of the further stands in each of the lines of laterally disposed stands is aligned with the sides of its rolls offset approximately 0° to said reference plane, and wherein another stand in each of the lines of laterally disposed stands is disposed at a distance from said one stand, and is aligned with the sides of its rolls offset approximately 90° to said reference plane, such that the sides of the rolls are offset by approximately 90°.

4. A no-twist slit rolling apparatus as claimed in claim 1 comprising means for delivering the rod segments from said further stands directly to cooling beds in substantially straight condition.

5. A no-twist slit rolling apparatus as claimed in claim 1 wherein said reference plane is vertical.

6. A no-twist slit rolling apparatus as claimed in claim 1 wherein the rolls in said further stands in each line are respectively oriented at 90° relative to one another in adjacent stands such that the rod segments travel from the slitter means to and through the further stands without intermediate twisting of the rod segments whereby said rod undergoes no intermediate twisting from its feed to said first stand to its discharge as rod segments from the last of said further stands in said offset lines.

7. A no-twist slit rolling apparatus as claimed in claim 6 wherein the total number of stands including stands of said slitter means is eight.

8. A no-twist slit rolling apparatus as claimed in claim 1 wherein said rolls of said first stand are configured to produce an oval cross section of the rolled rod, said oval cross section having a major axis inclined at an angle of 45° relative to said reference plane, said rolls of said second stand being configured to produce a substantially square cross section of the rolled rod having sides respectively parallel to and perpendicular to said reference plane, said slitter means having rolls configured to slit the square cross section of the rolled rod perpendicular to one of its sides.

9. A no-twist slit rolling method for the production of steel reinforcing bar from steel rod comprising the following steps:

a. rolling steel rod in a first stand having rolls aligned with the sides of the rolls offset approximately 45° in a first direction from a reference plane;

b. rolling the steel rod in a second stand having rolls aligned with the sides of the rolls offset approximately 45° in a second direction, opposite to said first direction, from said reference plane;

c. feeding the steel rod from the second stand, without intermediate twisting, to a splitter having rolls with sides inclined at an angle of 45° with respect to the sides of the rolls of the first and second stands;

d. rolling and splitting the steel rod into a plurality of steel rod segments in said splitter;

e. conveying the rod segments without intermediate twisting along respective laterally offset lines of rolls of further successive stands; and f. rolling each of the steel rod segments in the respective laterally offset lines through the successive stands and wherein the rolls in said successive stands are angularly offset from one anther by approximately 90°.

10. A method as claimed in claim 9 comprising positioning said reference plane vertically.

11. A method as claimed in claim 9 comprising positioning the sides of the rolls in the successive stands in said offset lines approximately at 45° relative to said reference plane.

12. A method as claimed in claim 9 comprising positioning the sides of the rolls of one of the successive stands in said offset lines approximately at 90° relative to said reference plane and positioning the sides of the rolls of an adjacent stand in said offset line approximately parallel to said reference plane.

13. A method as claimed in claim 9 comprising orienting the rolls in said further stands in each line at 90° relative to one another in adjacent stands such that the rod segments travel from the splitter to and through the further stands without intermediate twisting of the rod segments whereby said rod undergoes no intermediate twisting from its feed to said first stand to its discharge as rod segments from the last of said further stands in said offset lines.

14. A method as claimed in claim 9 comprising forming said rolls of said first stand to produce an oval cross section of the rolled rod, said oval cross section having a major axis inclined at an angle of 45° relative to said reference plane, forming said rolls of said second stand to produce a substantially square cross section of the rolled rod having sides respectively parallel to and perpendicular to said reference plane, and forming said splitter with rolls configured to slit the square cross section of the rolled rod perpendicular to one of its sides.

15. A method as claimed in claim 9 comprising feeding the rod segments from the last of said further stands in straight condition directly to cooling beds.

* * * * *